United States Patent [19]

Mason

[11] 4,045,834

[45] Sept. 6, 1977

[54] BACK-REST ATTACHMENT

[76] Inventor: David R. Mason, 4162 Dearborn St., East Chicago, Ind. 46312

[21] Appl. No.: 721,359

[22] Filed: Sept. 8, 1976

[51] Int. Cl.[2] ..... B63B 29/00

[52] U.S. Cl. ..... 9/7; 297/350

[58] Field of Search ..... 9/7; 279/252, 350, 352, 279/16, 379

[56] References Cited

U.S. PATENT DOCUMENTS

| | | | |
|---|---|---|---|
| 633,012 | 9/1899 | Kidd | 297/350 |
| 1,196,731 | 8/1916 | Clark | 297/350 |
| 2,382,953 | 8/1945 | Baxter | 297/379 |
| 2,989,115 | 6/1961 | Egles | 9/7 |

*Primary Examiner*—Trygve M. Blix
*Assistant Examiner*—D. W. Keen

[57] ABSTRACT

A back-rest attachment for a boat seat includes first and second pairs of rods spaced from, and hingeably, connected to one another, and a fabric connected between and attached to the rods of the first pair. The pairs of rods may be pivoted from a first position parallel to one another to a second position at right angles with one another, in which latter position the back-rest attachment may be fastened to a board. In a preferred version of my invention the rods are telescopically collapsible so that the back-rest attachment may be folded into a collapsed position, and wherein the folded fabric may be used as a handle.

1 Claim, 4 Drawing Figures

BACK-REST ATTACHMENT

BACKGROUND OF THE INVENTION

1. Field of the Invention

The field of the present invention relates to a back-rest attachment.

2. Description of the Prior Art

The first known back-rest attachment for a boat seat dates back to the 1890's. Since then there have been patented an adjustable folding boat seat, a detachable mounting for boat seats, a flatbottomed fishing boat, and a convertible sleeper seat for pleasure boats. All of the above back-rest attachments require a relatively large storage space.

SUMMARY OF THE INVENTION

It is, accordingly, an object of my invention to provide a foldable back-rest attachment for boat seats which takes up very little space in a collapsed position.

I accordingly provide a back-rest attachment for a boat seat which includes first and second rods substantially disposed in a first plane spaced from, and co-extensive with one another. Each rod has first and second ends, respectively, and a fabric disposed between, and attached to the first and second rods. Third and fourth rods are provided which are substantially disposed in a second plane and co-extensive with one another. The third and fourth rods have third and fourth ends, respectively, and the third ends of the third and fourth rods are pivotably attachable to the first ends of the first and second rods, respectively, for the second plane to subtend a range of angles from approximately zero to ninety degrees. First and second hinges may be connected to the first and third, and the second and fourth rods, respectively. The first and second hinges have snap-in means for holding the third and fourth rods in stabilized first and second positions; the second plane is substantially parallel with the first plane in the first position and substantially perpendicular thereto in the second position. Clip means may be attached to the third and fourth rods for clipping the back-rest attachment to board or the like. Each rod is preferably telescopically collapsible for the back-rest attachment to be folded into a collapsed position, and for the folded fabric to be used as a handle. First and second caps may be attached to the second ends of the first and second rods, respectively, and each rod has selectable extended and a collapsed position. Snap-in means are provided in each rod for keeping it in the selected extended or collapsed position.

BRIEF DESCRIPTION OF THE DRAWING

My invention will be better understood with reference to the accompanying drawing in which.

DESCRIPTION OF THE PREFERRED EMBODIMENT

Figure 1:
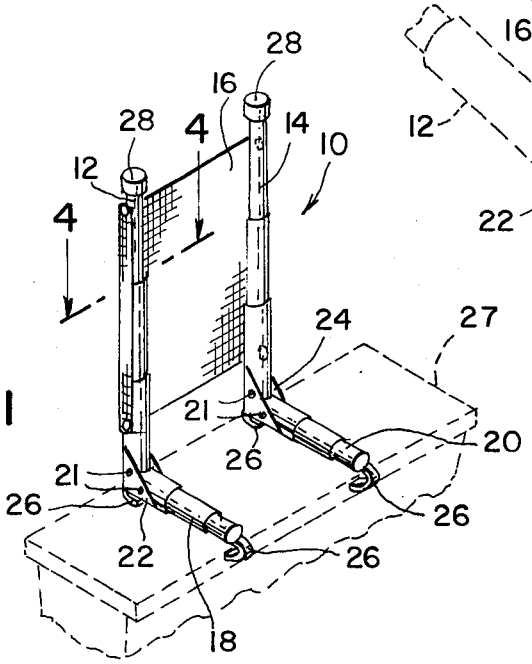
FIG. 1 shows a perspective view of the back-rest attachment for a boat seat, according to my invention.
Figure 3:
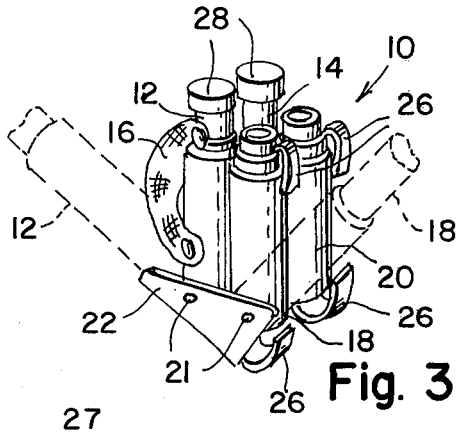
FIG. 3 shows the back-rest attachment in an extreme collapsed position.
Figure 2:
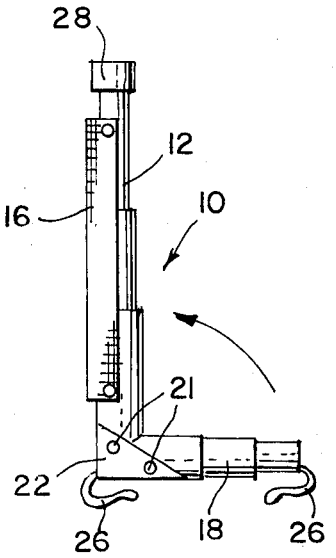
FIG. 2 is a side elevation corresponding to FIG. 1.
Figure 4:
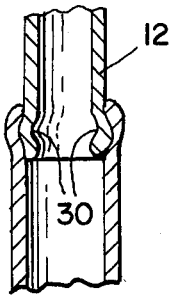
FIG. 4 shows a detail of the snap-in means for a rod of the back-rest attachment.

Referring now to the drawing, a back-rest attachment 10 for a boat seat includes a first rod 12 and a second rod 14 substantially disposed in a first plane, spaced from, and co-extensive with one another; each of the rods 12 and 14 has first and second ends, respectively, and a fabric 15 is disposed between the first rod 12 and the second rod 14, and attached thereto. A third rod 18 and a fourth rod 20 are substantially disposed in a second plane and co-extensive with one another, and have third and fourth ends, respectively. The third ends of the third rod 18 and the fourth rod 20 are pivotably attachable to the first ends of the first rod 12 and the second rod 14, respectively, for the second plane to subtend a range of angles from approximately 0° to 90°. A first hinge 22 and a second hinge 24 may be connected to the first rod 12, and a third rod 18 on one hand, and the second rod 14 and the fourth rod 20 on the other hand, respectively; first snap-in means 21 are provided for holding the third rod 18 and the fourth rod 20 in stabilized first and second positions. The second plane is substantially parallel with the first plane in the first position, and substantially perpendicular thereto in the second position. Clip means 26 may be attached to the third rod 18, and the fourth rod 20 for clipping the back-rest attachment 10 to a board 27 or the like. Each of the rods, 12, 14, 18 and 20 is preferably telescopically collapsible for the back-rest attachment 10 to be folded into a collapsed position; the folded fabric 16 can then be used as a handle, and first and second caps 28 may be attached to the second end of the first rod 12, and the second rod 14, respectively. Each of the rods 12, 14, 18 and 20 has selectable extended and collapsed positions and includes snap-in means 30 for keeping each rod in the selected extended or collapsed position.

Although the invention has been described with respect to a preferred version thereof, it is to be understood that it is not to be so limited since changes can be made therein which are within the full intended scope of the appended claims.

What is claimed is:

1. A back-rest attachment for a boat seat comprising:

first and second rods substantially disposed in a first plane and spaced from, and co-extensive with one another, each of said rods having first and second ends, respectively;

a fabric disposed between said first and second rods, and attached thereto;

third and fourth rods substantially disposed in a second plane and co-extensive with one another, having third and fourth ends, respectively, said third ends of said third and fourth rods being pivotably attachable to said first ends of said first and second rods, respectively, for said second plane to subtend a range of angles from approximately 0° to 90°;

first and second hinges connectable to said first and third, and said second and fourth rods, respectively, having snap-in means for holding said third and fourth rods in stabilized first and second positions, said second plane being substantially parallel with said first plane in said first position, and substantially perpendicular thereto in said second position; and clip means attachable to said third and fourth rods for clipping the back-rest attachment to a board or the like. and wherein each of said rods is telescopically collapsible for said backrest attachment to be foldable into a collapsed position, and the folded fabric to be usable as a handle, and further comprising first and second caps attachable to said second ends of said first and second rods, respectively, and wherein each of said rods has selectable extended and collapsed positions and including snap-in means for keeping each of said rods in the selected position of said extended and collapsed positions.

* * * * *